US010937404B2

(12) United States Patent
Sato et al.

(10) Patent No.: US 10,937,404 B2
(45) Date of Patent: Mar. 2, 2021

(54) ELECTRONIC KEYBOARD INSTRUMENT, METHOD, AND STORAGE MEDIUM

(71) Applicant: CASIO COMPUTER CO., LTD., Tokyo (JP)

(72) Inventors: Hiroki Sato, Tokyo (JP); Hajime Kawashima, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 16/582,166

(22) Filed: Sep. 25, 2019

(65) Prior Publication Data

US 2020/0126526 A1 Apr. 23, 2020

(30) Foreign Application Priority Data

Oct. 17, 2018 (JP) ..... JP2018-196003

(51) Int. Cl.
*G10H 1/053* (2006.01)
*G10H 1/34* (2006.01)

(52) U.S. Cl.
CPC ..... *G10H 1/053* (2013.01); *G10H 1/344* (2013.01); *G10H 2220/221* (2013.01)

(58) Field of Classification Search
CPC ... G10H 1/053; G10H 1/344; G10H 2220/221
See application file for complete search history.

(56) References Cited

U.S. PATENT DOCUMENTS 4,668,843 A * 5/1987 Watanabe ..... H01H 13/705 200/5 A
5,062,342 A * 11/1991 Nagatsuma ..... G10H 1/346 84/439
5,453,571 A * 9/1995 Adachi ..... G10H 1/053 84/626
6,376,759 B1 * 4/2002 Suzuki ..... G10H 1/053 84/615
6,849,796 B2 * 2/2005 Yamaguchi ..... G10H 1/344 84/720
9,613,607 B2 * 4/2017 Osuga ..... G10H 1/344
2002/0046640 A1 * 4/2002 Kondo ..... G10H 1/053 84/615
2003/0131720 A1 * 7/2003 Sakurada ..... G10H 1/346 84/719

(Continued)

FOREIGN PATENT DOCUMENTS

JP H04-077793 A 3/1992
JP H06-161443 A 6/1994

(Continued)

*Primary Examiner* — Jeffrey Donels
(74) *Attorney, Agent, or Firm* — Chen Yoshimura LLP

(57) ABSTRACT

An electronic keyboard instrument includes: a keyboard including a plurality of keys; a plurality of switches that are provided for each key and include a first switch and a second switch that are sequentially turned on by pressing of the key; and a processor. The processor instructs that a noise sound corresponding to a selected musical instrument sound be produced in accordance with a prescribed first envelope upon detecting turning on of the first switch by pressing of the key, and instructs that a main musical sound corresponding to the selected musical instrument sound be produced after detecting turning on of the second switch.

13 Claims, 9 Drawing Sheets

(56) References Cited

U.S. PATENT DOCUMENTS

| | | | | |
|---|---|---|---|---|
| 2008/0236363 | A1* | 10/2008 | Ohta | G10H 1/344 84/600 |
| 2011/0239846 | A1* | 10/2011 | Shimoda | G10H 1/344 84/687 |
| 2012/0174729 | A1* | 7/2012 | Sawada | G10H 1/346 84/236 |

FOREIGN PATENT DOCUMENTS

| | | | |
|---|---|---|---|
| JP | 3713180 | B2 | 11/2005 |
| JP | 2008-89644 | A | 4/2008 |

* cited by examiner

ELECTRONIC KEYBOARD INSTRUMENT, METHOD, AND STORAGE MEDIUM

TECHNICAL FIELD

The present invention relates to an electronic keyboard instrument, a method, and a storage medium.

BACKGROUND ART

Heretofore, a variety of technologies have been developed for reproducing the sounds of various acoustic musical instruments such as wind instruments and plucked string instruments in electronic keyboard instruments. In an electronic keyboard instrument, when a particular key is pressed, a contact disposed below the key is turned on and a musical sound corresponding to the selected musical instrument sound starts to be produced. For example, in an electronic keyboard instrument disclosed in Japanese Patent No. 3713180, a musical sound starts to be produced when either a first contact or a second contract point is turned on as a result of a key being pressed.

SUMMARY OF THE INVENTION

However, in acoustic musical instruments such as wind instruments and plucked string instruments, a noise sound such as an attack noise sound may be generated before a musical sound having a musical interval (hereafter, a "main musical sound") is produced. However, in the electronic keyboard instrument disclosed in Patent Document 1, noise sounds and main musical sounds are not individually controlled and produced, and therefore noise sounds generated in an acoustic musical instrument are not appropriately reproduced. The present invention is advantageous in that noise sounds generated in an acoustic musical instrument can be reproduced.

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present disclosure provides an electronic keyboard instrument including: a keyboard including a plurality of keys; a plurality of switches for each of the plurality of keys, the plurality of switches in each of the plurality of keys including a first switch and a second switch that are sequentially turned on in the order of the first switch first and the second switch thereafter when the key is pressed; and a processor; wherein the processor: causes a noise sound corresponding to a musical instrument sound to be produced in accordance with a prescribed first envelope that determines volume changes over time, upon detecting turning on of the first switch by pressing of the key; and causes a main musical sound corresponding to said musical instrument sound to be produced after detecting turning on of the second switch.

In another aspect, the present disclosure provides a method performed by the processor of the above-described electronic keyboard instrument, including the above-described operations.

In another aspect, the present disclosure provides a non-transitory computer-readable storage medium having stored thereon an program executable by the processor of the above-described electronic keyboard instrument, the program causing the processor to perform the above-described operations.

It is to be understood that both the foregoing general description and the following detailed description are exemplary and explanatory, and are intended to provide further explanation of the invention as claimed.

DETAILED DESCRIPTION OF EMBODIMENTS

Figure 1:
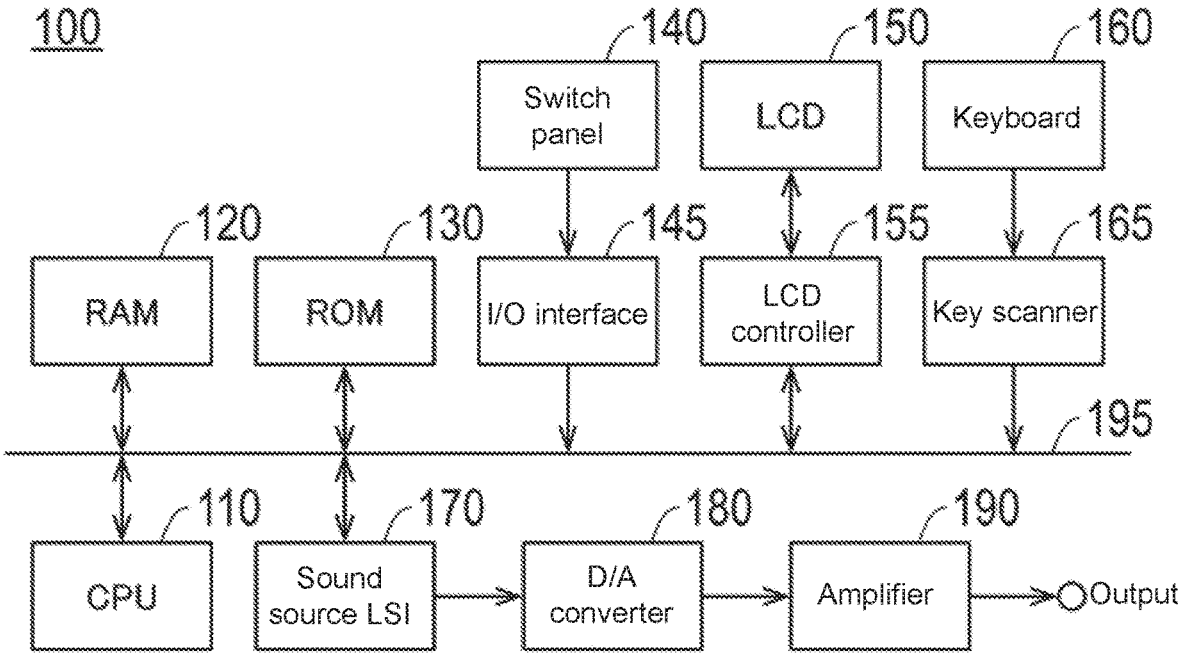
FIG. 1 is a block diagram illustrating the hardware configuration of an electronic keyboard instrument according to an embodiment of the present invention.

Hereafter, an embodiment of the present invention will be described while referring to the attached drawings. Elements that are the same as each other will be denoted by the same symbols and repeated description thereof will be omitted. In addition, the dimensional ratios in the drawings may be exaggerated for convenience of explanation and differ from the actual ratios.

[Configuration]

Figure 2:
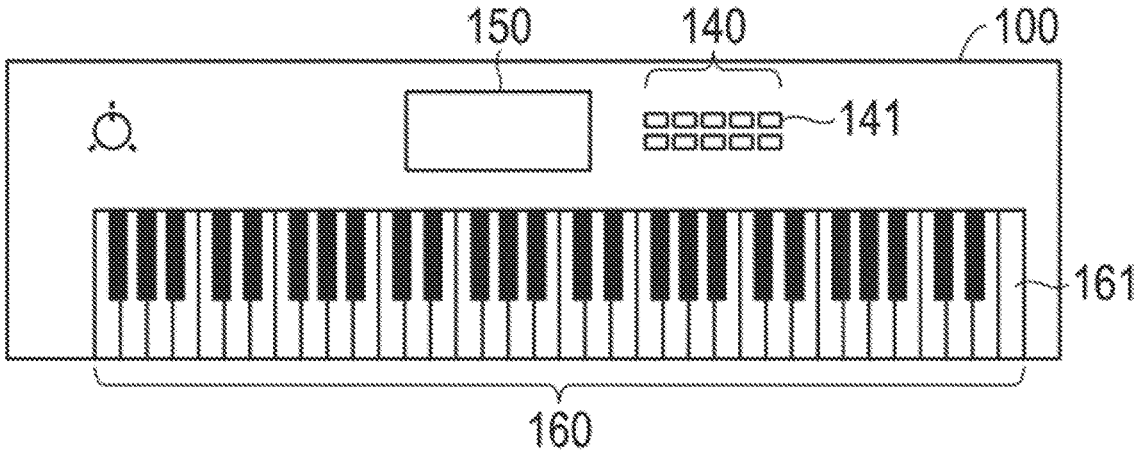
FIG. 2 is a diagram illustrating an example of the external appearance of the electronic keyboard instrument.
Figure 3:
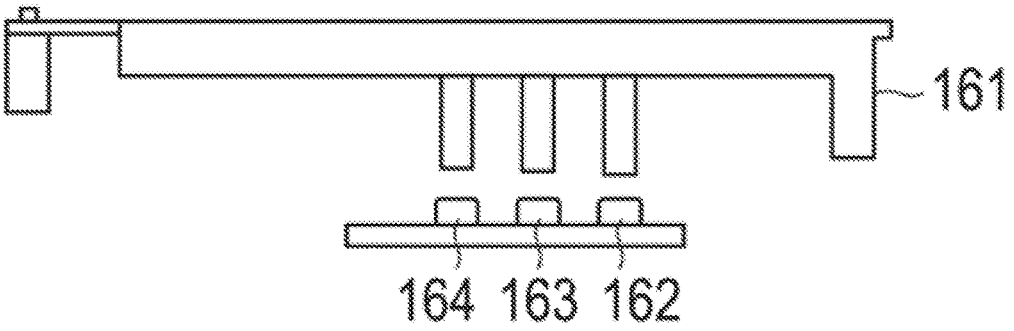
FIG. 3 is a diagram illustrating an example of the structure of each key of a keyboard.

FIG. 1 is a block diagram illustrating the hardware configuration of an electronic keyboard instrument according to an embodiment of the present invention. FIG. 2 is a diagram illustrating an example of the external appearance of the electronic keyboard instrument. FIG. 3 is a diagram illustrating an example of the structure of each key of a keyboard. Sound weakening processing including silencing described below is so-called muting processing.

As illustrated in FIGS. 1 and 2, an electronic keyboard instrument 100 includes a central processing unit (CPU) 110, a random access memory (RAM) 120, a read only memory (ROM) 130, a switch panel 140, a liquid crystal display (LCD) 150, a keyboard 160, a sound source large scale integrated circuit (LSI) 170, a D/A converter 180, and an amplifier 190. The CPU 110, the ROM 130, the RAM 120, and the sound source LSI 170 are connected to a bus 195. In addition, the switch panel 140, the LCD 150, and the keyboard 160 are connected to the bus 195 via an I/O interface 145, an LCD controller 155, and a key scanner 165, respectively.

The CPU 110 functions as a processor (control unit) and controls the above-described constituent elements and executes various arithmetic processing operations in accordance with programs. The RAM 120 functions as a work area and temporarily stores programs, data, and so forth.

The ROM 130 includes a program area and a data area, and stores various programs, various data, and so forth in advance. The ROM 130 for example functions as a waveform memory and stores musical sound waveform data of various musical instruments. More specifically, the ROM 130 stores noise sound waveform data and main musical sound waveform data for musical instruments that generate noise sounds (attack noise sounds) such as wind instruments and plucked string instruments. The ROM 130 for example may store waveform data of a breath noise sound generated when a player blows into the wind instrument as waveform data of a noise sound of a wind instrument. In addition, the ROM 130 may store waveform data of a picking noise sound generated when a pick touches a string or rubs against a string as waveform data of a noise sound of a plucked string instrument such as a guitar. The picking noise sound may include a high-frequency (short wavelength) noise sound generated by a string vibration that depends the distance between the position where the pick touches the string and the bridge saddle (bridge). Furthermore, the ROM 130 may instead store only the waveform data of main musical sounds for musical instruments that do not generate noise sounds.

The switch panel 140 includes a plurality of switches 141 that serve as operation elements and accepts operations performed by a player by pressing the plurality of switches 141. For example, the switch panel 140 includes a plurality of switches 141 that serve as operation elements for selecting any musical instrument sound from among a plurality of musical instrument sounds. The I/O interface 145 monitors the plurality of switches 141 of the switch panel 140 and notifies the CPU 110 upon detecting pressing of any of the plurality of switches 141.

The LCD 150 displays various information. The LCD controller 155 is an integrated circuit (IC) that controls the LCD 150.

The keyboard 160 includes a plurality of keys 161 and accepts key press operations and key release operations performed by a player. For example, as illustrated in FIG. 3, the plurality of keys 161 each operate with one end of a plate spring or the like acting as a fulcrum, and are each provided with a plurality of switches (contacts) 162 to 164 therebelow. The plurality of switches 162 to 164 are turned on in the order of a front switch (third switch) 162, a middle switch (first switch) 163, and a rear switch (second switch) 164 when the key is pressed. In addition, the plurality of switches 162 to 164 are turned off on the order of the rear switch 164, the middle switch 163, and the front switch 162 when the key is released.

The key scanner 165 monitors the plurality of keys 161 of the keyboard 160 and detects pressing and releasing of the plurality of keys 161. For example, when the key scanner 165 detects pressing of a key, the key scanner 165 detects and notifies the CPU 110 of the key number (note number) of the pressed key 161 and the velocity (key press speed) of the pressed key 161 at the time when the pressed key 161 was pressed. In addition, when the key scanner 165 detects releasing of a key, the key scanner 165 detects and notifies the CPU 110 of the key number of the released key 161 and the velocity (key release speed) of the released key 161 at the time when the released key 161 was released.

The key scanner 165 detects the velocity when a key is pressed or released by measuring the time difference between when turning on or off of at least two switches among the plurality of switches 162 to 164 is detected. For example, the key scanner 165 acquires the velocity when a key is pressed by measuring the time difference from when turning on of the front switch 162 is detected until when turning on of the middle switch 163 is detected. When the CPU 110 detects that the middle switch 163 has been turned on based on the notification from the key scanner 165, the CPU 110 executes middle switch on processing, which is processing for producing a noise sound. Furthermore, when the CPU 110 detects that the rear switch 164 has been turned on, the CPU 110 executes rear switch on processing, which is processing for producing a main musical sound. In addition, when the CPU 110 detects that the front switch 162 has been turned off, the CPU 110 executes sound weakening, including silencing, processing, which is processing for weakening and silencing a noise sound and/or a main musical sound. The CPU 110 instructs the sound source LSI 170 to produce the noise sound and the main musical sound at different timings. Furthermore, the CPU 110 instructs the sound source LSI 170 to silence the noise sound and the main musical sound at different timings or at the same timing.

The sound source LSI 170 reads out the waveform data of a selected musical instrument sound from the ROM 130, which employs a known waveform memory read out method and functions as a waveform memory. The sound source LSI 170 has a plurality of channels and is configured so as to be able to read out different waveform data through the plurality of channels. For example, the sound source LSI 170 is configured so as to be able to read out waveform data of a noise sound through a certain channel and read out waveform data of a main musical sound through another channel. The sound source LSI 170 processes the read out waveform data and outputs the processed waveform data to the D/A converter 180. The sound source LSI 170 will be described in detail later.

The D/A converter 180 converts digital waveform data output from the sound source LSI 170 into an analog waveform signal and outputs the analog waveform signal to the amplifier 190. The amplifier 190 amplifies the analog waveform signal output from the D/A converter 180 and outputs the amplified analog waveform signal to a speaker or an output terminal (neither of which is illustrated), for example.

The electronic keyboard instrument 100 may include constituent elements other than those described above and some of the constituent elements described above may be omitted.

Figure 4:
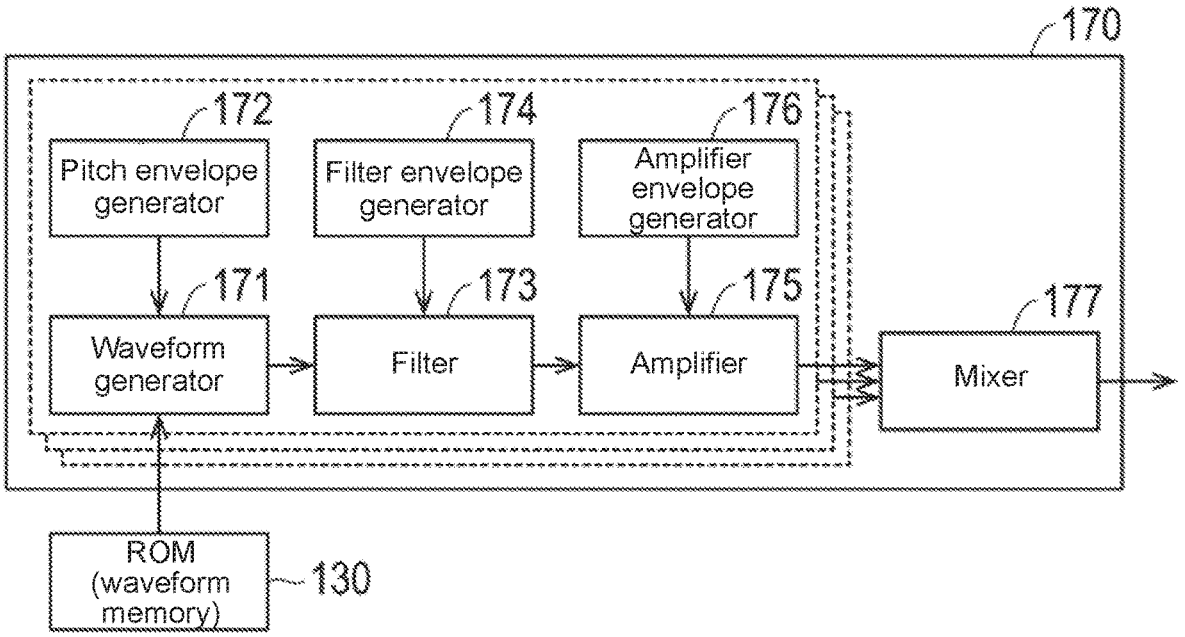
FIG. 4 is a block diagram illustrating the schematic configuration of a sound source LSI.

Next, the sound source LSI 170 will be described in detail. FIG. 4 is a block diagram illustrating the schematic configuration of a sound source LSI.

As illustrated in FIG. 4, the sound source LSI 170 functions as a waveform generator 171, a pitch envelope generator 172, a filter 173, a filter envelope generator 174, an amplifier 175, and an amplifier envelope generator 176. The sound source LSI 170 functions as the various constituent elements for a plurality of channels. In addition, the sound source LSI 170 also functions as a mixer 177 that adjusts and mixes the outputs from the amplifier 175 in each of the plurality of channels.

The waveform generator 171 generates a pitch-controlled waveform in accordance with a pitch envelope representing changes in pitch over time set by the pitch envelope generator 172. More specifically, the waveform generator 171 controls pitch by reading out waveform data from the ROM 130 at a read out speed corresponding to the pitch envelope. The waveform generator 171 may generate a sustained sound waveform by executing loop processing in which waveform data is repeatedly read out from the ROM 130. The filter 173 controls the sound quality of the sound based on the waveform in accordance with a filter envelope representing the changes over time of a cutoff frequency of a filter (for example, low pass filter) set by the filter envelope generator 174. The amplifier 175 controls the level of the sound based on the waveform in accordance with an amplifier envelope representing (determining) the changes over time of the level (volume) set by the amplifier envelope generator 176.

The envelope generators 172, 174, and 176 each set an envelope on the basis of parameters supplied from the CPU 110. For example, the amplifier envelope generator 176 sets an amplifier envelope for the waveform of a noise sound (hereafter "noise sound envelope" or "first envelope") for the channel through which the waveform data of the noise sound is read out. In addition, the amplifier envelope generator 176 sets an amplifier envelope for the waveform of a main musical sound (hereafter "musical sound envelope" or "second envelope") for the channel through which the waveform data of the main musical sound is read out. Hereafter, the noise sound envelopes and musical sound envelopes at the time of a key press and the time of a key release will be described in detail.

[Amplifier Envelope at Time of Key Press]

Figure 5:
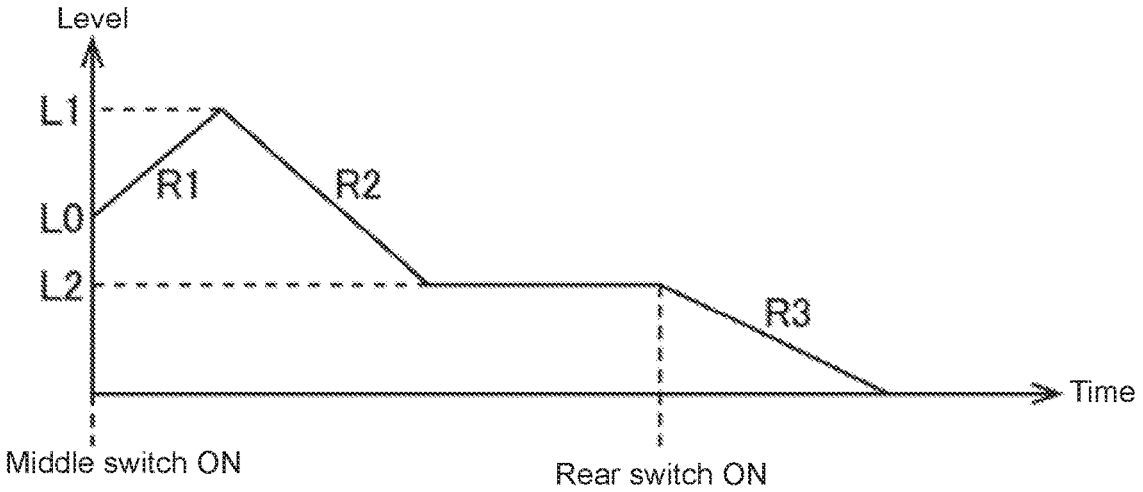
FIG. 5 is a diagram for explaining setting of an amplifier envelope for when a key is pressed.
Figure 6A:
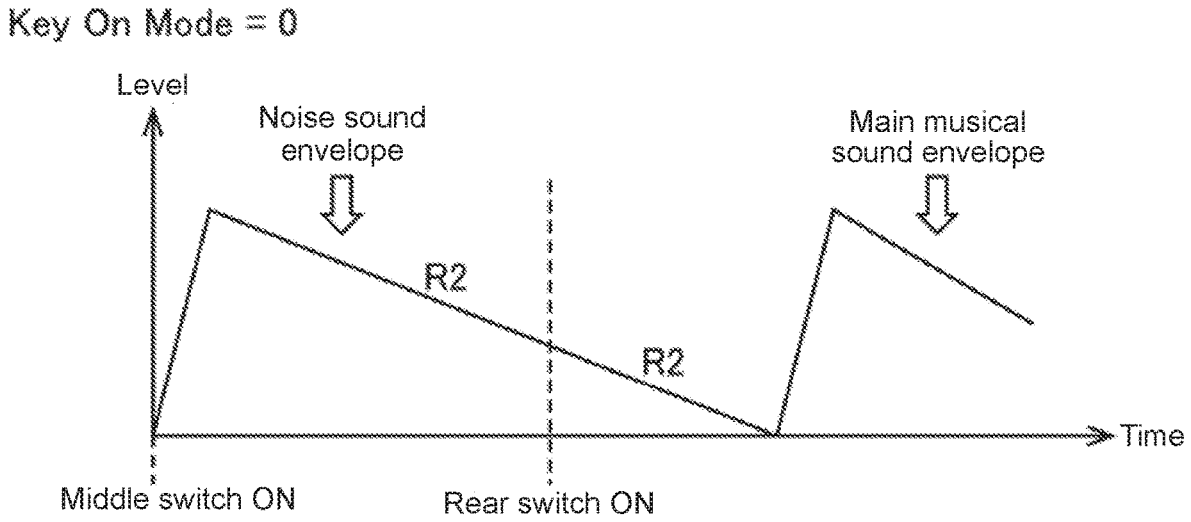
FIG. 6A is a diagram illustrating an example of an amplifier envelope for when a key is pressed.
Figure 6B:
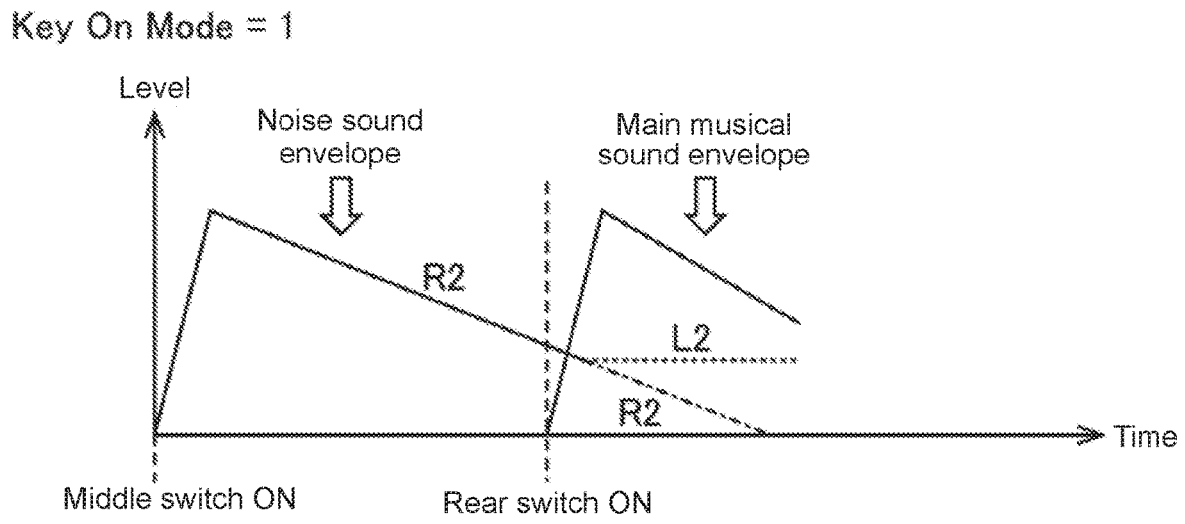
FIG. 6B is a diagram illustrating another example of an amplifier envelope for when a key is pressed.
Figure 6C:
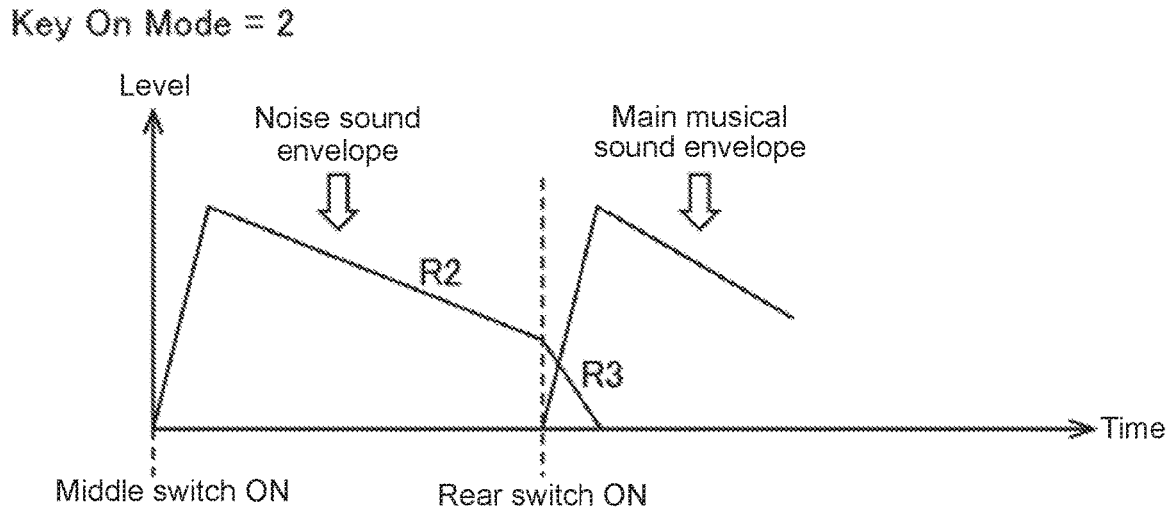
FIG. 6C is a diagram illustrating yet another example of an amplifier envelope for when a key is pressed.

FIG. 5 is a diagram for explaining setting of an amplifier envelope for when a key is pressed. FIG. 6A is a diagram illustrating an example of an amplifier envelope for when a key is pressed. FIG. 6B is a diagram illustrating another example of an amplifier envelope for when a key is pressed. FIG. 6C is a diagram illustrating yet another example of an amplifier envelope for when a key is pressed.

The amplifier envelope for when a key is pressed is set on the basis of a plurality of parameters that change with time. For example, as illustrated in FIG. 5, the noise sound envelope for when a key is pressed is set on the basis of parameters relating to various levels such as an initial level L0, an attack level L1, and a sustain level L2 and relating to various rates such as an attack rate R1, a decay rate R2, and a release rate R3. As an example, the level L0 may be set to be around 60% of the level L1, the level L2 may be set to around 50% of the level L1, and the time from when turning on of the middle switch 163 is detected until when the level reaches 0 (zero) may be set to around 1 second. In addition, the level L2 may be set to 0 in the case where the noise sound is a decaying sound and may be set to a value other than 0 in the case where the noise sound is a sustained sound. Furthermore, the rate R3 may be set so as to be steeper than the rate R2 in order to cause the noise sound to decay and weaken by a greater amount after turning on of the rear switch 164 has been detected. The musical sound envelope for when a key is pressed may also be set on the basis of the same parameters as those described above.

The level of the noise sound changes from level L0 to level L1 at the rate R1, and then changes to the level L2 at the rate R2. However, if turning on of the rear switch 164 is detected before the level of the noise sound reaches the level L2, the rate R2 can be immediately changed to the rate R3. When the level of the noise sound reaches L2 in the case where the level L2 was set to 0 or when the level of the noise sound reaches 0 at the rate R3, the amplifier envelope generator 176 is stopped and reading out of the waveform data by the waveform generator 171 is also stopped.

In this embodiment, amplifier envelopes are set for any of the three modes (Key On Mode=0, 1, 2) exemplified in FIGS. 6A to 6C as a noise sound envelope and a musical sound envelope for when a key is pressed. The three modes may be automatically selected in accordance with the musical instrument sound selected on the switch panel 140. In FIGS. 6A to 6C, the level L2 in the noise sound envelope is set to 0 and the highest level of the noise sound envelope and the musical sound envelope are illustrated as being substantially the same, but the actual amplifier envelope settings are not limited to this example.

(Key On Mode=0)

In the case of Key On Mode=0, when turning on of the middle switch 163 is detected, a noise sound is produced in accordance with the noise sound envelope illustrated in FIG. 6A. Then, when turning on of the rear switch 164 is detected before reading out of the waveform data of the noise sound is complete or before the level of the noise sound has decayed and reached 0, production of the main musical sound is put into a pending state. Then, once reading out of the waveform data of the noise sound is complete or once the level of the noise sound has decayed and reached 0, the main musical sound is produced in accordance with the musical sound envelope illustrated in FIG. 6A.

(Key On Mode=1)

As illustrated in FIG. 6B, in the case of Key On Mode=1, when turning on of the middle switch 163 is detected, a noise sound is produced in accordance with the noise sound envelope illustrated in FIG. 6B, similarly to as in the case where Key On Mode=0. However, in contrast to the case of Key On Mode=0, if turning on of the rear switch 164 is detected while the noise sound is being produced, the noise sound will continue to be produced without changing the parameters of the noise sound envelope, and the main musical sound will be immediately produced. As illustrated in FIG. 6B, the noise sound may be a sustained sound (dotted line) in which the level is maintained at the level L2 after decaying by a certain amount at the rate R2 or the noise sound may be decaying sound (one-dot chain line) that continuously slowly decays at the rate R2. In the case where the noise sound is a sustained sound, the waveform generator 171 may execute loop processing in which waveform data is repeatedly read out from the ROM 130.

For example, amplifier envelope of the Key On Mode=1 is set in the case where the tone color of a wind instrument is selected on the switch panel 140. As a result, reproduction is performed such that production of a breath noise sound of the wind instrument caused by the player blowing into the wind instrument is started before production of the main musical sound is started and production of the breath noise sound is continued after production of the main musical sound has started.

(Key On Mode=2)

As illustrated in FIG. 6C, in the case of Key On Mode=2, similarly to as in the case of Key On Mode=1, when turning on of the rear switch 164 is detected while the noise sound is being produced, the main musical sound is immediately produced. However, in contrast to the case of Key On Mode=1, when turning on of the rear switch 164 is detected while the noise sound is being produced, the parameters of the noise sound envelope are changed (rate R3 is set) and the noise sound is made to greatly decay and weaken at the rate R3.

The amplifier envelope of Key On Mode=2 is, for example, set in the case where the tone color of a plucked string instrument such as a guitar is selected on the switch panel 140. As a result, reproduction is performed such that production of a picking noise sound of a plucked string instrument caused by a pick touching a string or rubbing against a string is started before production of the main musical sound is started and production of the picking noise sound does not continue after production of the main musical sound has started.

[Amplifier Envelope at Time of Key Release]

Figure 7:
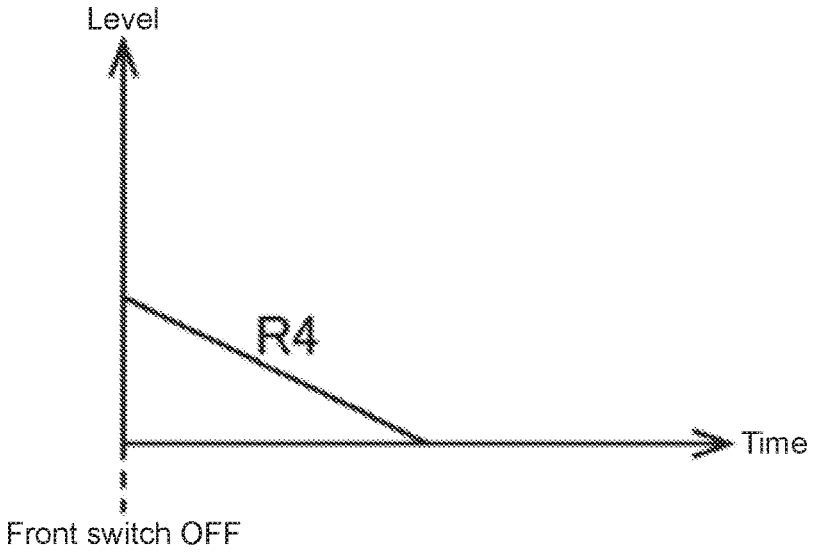
FIG. 7 is a diagram for explaining setting of an amplifier envelope for when a key is released.
Figure 8A:
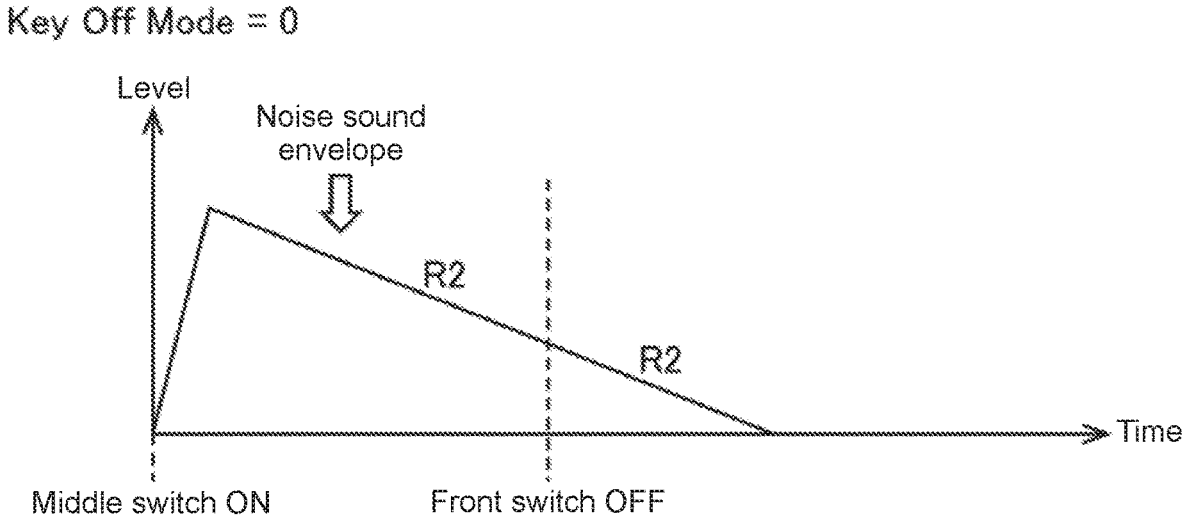
FIG. 8A is a diagram illustrating an example of an amplifier envelope for when a key is released.
Figure 8B:
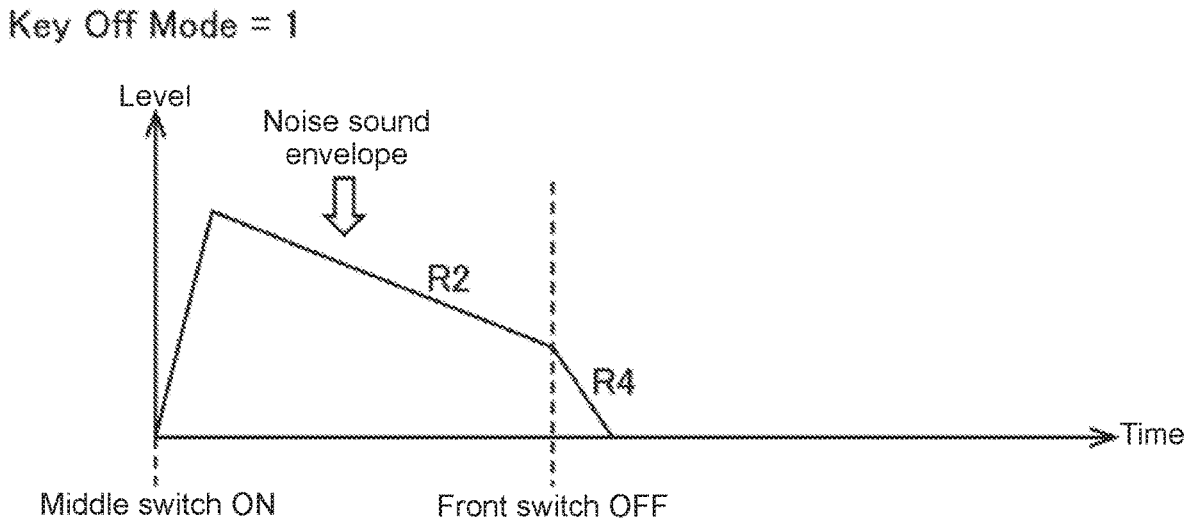
FIG. 8B is a diagram illustrating another example of an amplifier envelope for when a key is released.

FIG. 7 is a diagram for explaining setting of an amplifier envelope for when a key is released. FIG. 8A is a diagram illustrating an example of an amplifier envelope for when a key is released. FIG. 8B is a diagram illustrating another example of an amplifier envelope for when a key is released.

As illustrated in FIG. 7, the amplifier envelope for when a key is released is set on the basis of parameters related to a release rate R4. Up until turning off of the first switch is detected, the initial level of the amplifier envelope for when a key is released corresponds to the level of sound that changes in accordance with the amplifier envelope for when a key is pressed. The rate R4 may be set so as to be steeper than the rate R2 in order to cause the sound to decay and weaken more greatly after turning off of the front switch 162 has been detected. When the level reaches 0 at the rate R4, the amplifier envelope generator 176 is stopped and reading out of the waveform data by the waveform generator 171 is also stopped. In this embodiment, amplifier envelopes are set for any of the two modes (Key Off Mode=0 or 1) exemplified in FIGS. 8A and 8B as a noise sound envelope and a musical sound envelope for when a key is released. The two modes may be automatically selected in accordance with the musical instrument sound selected on the switch panel 140. As illustrated in FIGS. 8A and 8B, in particular, the two modes may be modes in which a case is assumed in which turning off of the front switch 162 is detected without detection of turning on of the rear switch 164 after turning on of the middle switch 163 has been detected.

(Key Off Mode=0)

As illustrated in FIG. 8A, in the case of Key Off Mode=0, production of the noise sound continues even when turning off of the front switch 162 is detected while the noise sound is being produced.

(Key Off Mode=1)

As illustrated in FIG. 8B, in the case of Key Off Mode=1, if turning off of the front switch 162 is detected while the noise sound is being produced, the parameters of the noise sound envelope are changed (rate R4 is set) and the noise sound greatly decays and weakens at the rate R4. For example, Key Off Mode=1 is set in the case where the tone color of a wind instrument or a plucked string instrument such as a guitar is selected. Thus, reproduction is performed such that a breath noise sound or a picking noise sound weakens after the performance operation carried out by the player is stopped.

[Operation]

Figure 9:
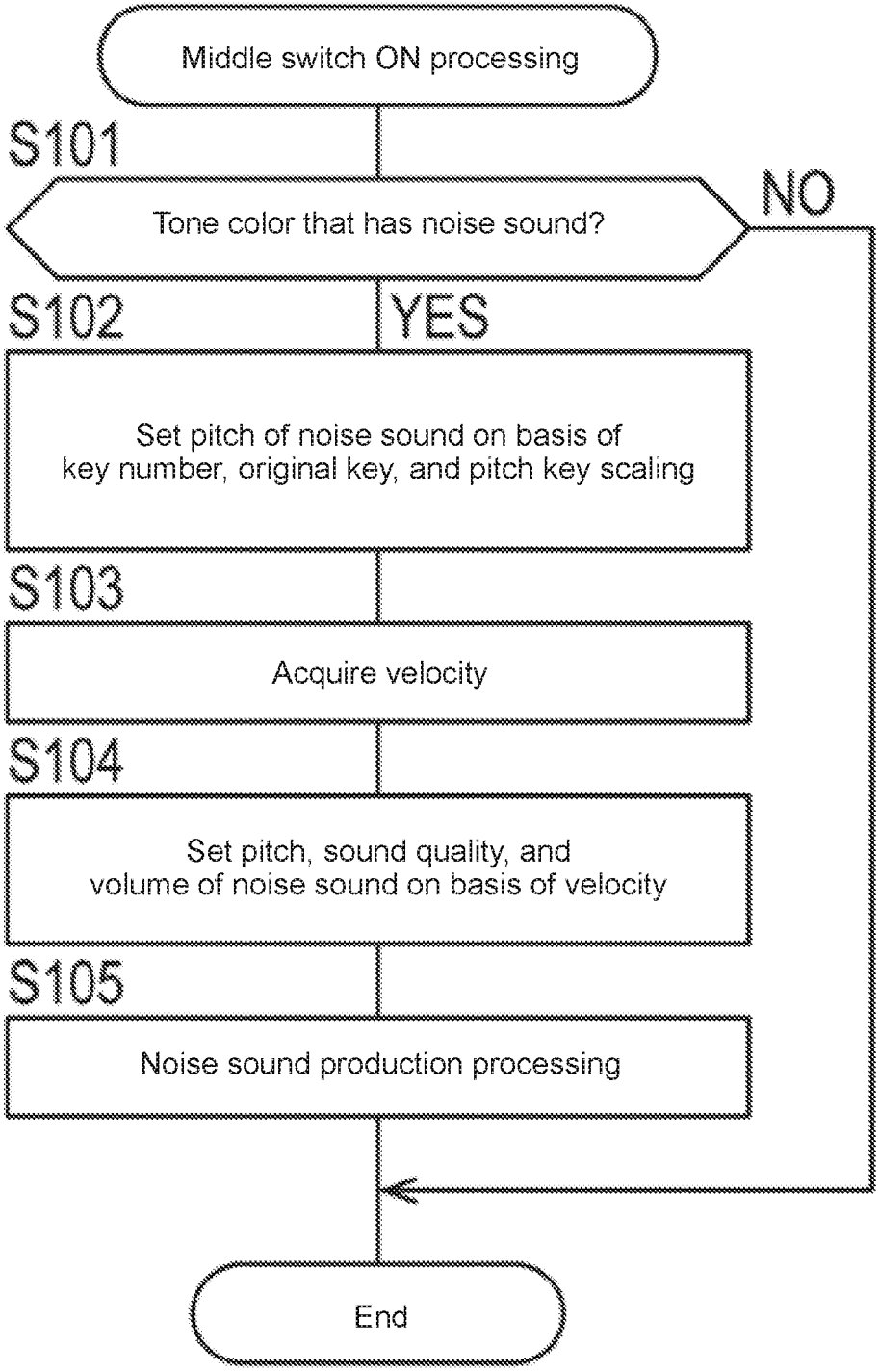
FIG. 9 is a flowchart illustrating the procedure of middle switch on processing.
Figure 10:
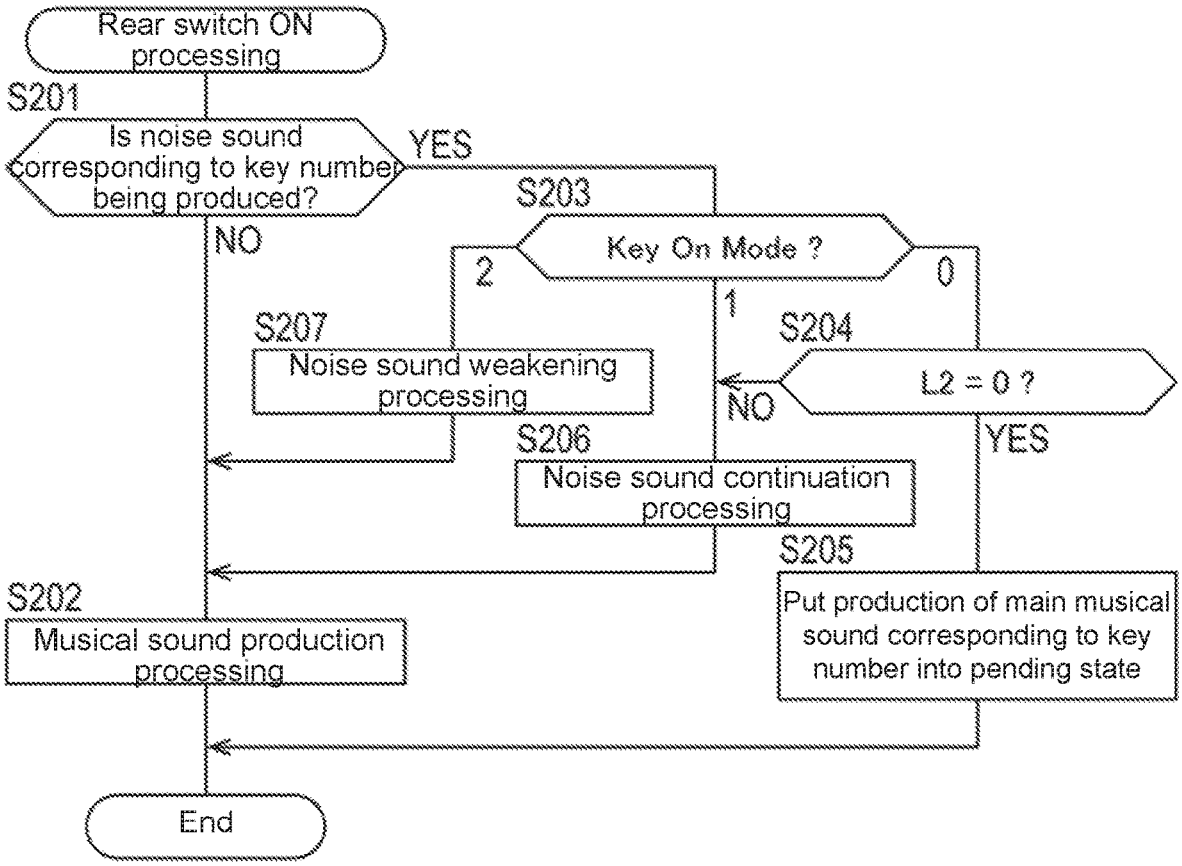
FIG. 10 is a flowchart illustrating the procedure of rear switch on processing.
Figure 11:
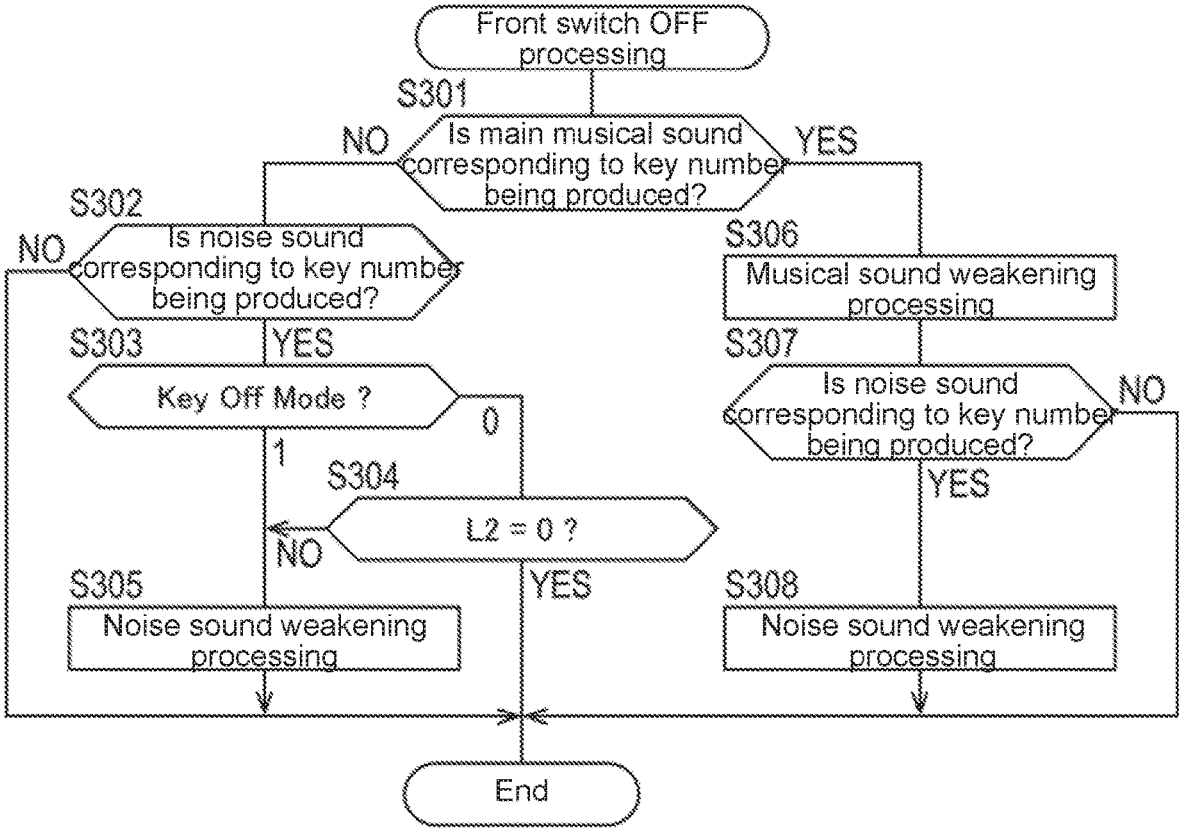
FIG. 11 is a flowchart illustrating the procedure of front switch off processing.

Next, operation of processing executed by the CPU 110 will be described in detail while referring to FIGS. 9 to 11. Middle switch on processing illustrated in FIG. 9 is processing for producing a noise sound. Rear switch on processing illustrated in FIG. 10 is processing for producing a main musical sound. Front switch off processing illustrated in FIG. 11 is processing for weakening, including silencing, the noise sound and/or the main musical sound.

(Middle Switch on Processing)

FIG. 9 is a flowchart illustrating the procedure of middle switch on processing. The algorithm illustrated in the flowchart of FIG. 9 is stored as a program in the ROM 130 or the like, and is executed by the CPU 110.

As illustrated in FIG. 9, when the CPU 110 detects turning on of the middle switch 163, the CPU 110 determines whether the tone color of the musical instrument selected on the switch panel 140 is the tone color of a musical instrument that generates a noise sound such as a wind instrument or a plucked string instrument (step S101).

In the case where it is determined that the tone color of the selected musical instrument is not the tone color of a musical instrument that generates a noise sound (step S101: NO), the CPU 110 ends the middle switch on processing.

In the case where it is determined that the tone color of the selected musical instrument is the tone color of a musical instrument that generates a noise sound (step S101: YES), the CPU 110 advances to the processing of step S102. Then, the CPU 110 acquires the pitch of a noise sound corresponding to the key number of the key 161 provided with the middle switch 163 that was turned on based on the key number, an original key number, and a pitch key scaling of the key 161 and sets the acquired pitch in the sound source LSI 170 (step S102). The original key number is a key number used as a reference for pitch key scaling, and for example is a key number that corresponds to the original pitch of the waveform data read out from the ROM 130. Pitch key scaling indicates the degree of change in pitch of another key number based on the pitch of the original key number. The pitch key scaling may be set for each tone color or each tone range, and for example, for the picking noise sound of a plucked string instrument such as a guitar, the pitch key scaling may be set so that the pitch changes in accordance with a change in key number corresponding to a change that occurs from one string to an adjacent string. On the other hand, the pitch key scaling may be set so that, for the breath noise sound of a wind instrument, the pitch does not change by a large amount with a change in key number.

Next, the CPU 110 acquires the velocity at the time when the key was pressed for the key 161 provided with the middle switch 163 that was turned on (step S103). The CPU 110 acquires the velocity at the time when the key 161 was pressed by measuring the time difference from when turning on of the front switch 162 was detected until when turning on of the middle switch 163 was detected. Therefore, the CPU 110 may start executing velocity measurement processing when turning on of the front switch 162 is detected.

Next, the CPU 110 acquires parameters such as the pitch offset amount, sound quality, and volume of the noise sound set in step S102 on the basis of the velocity acquired in step S103, and sets the parameters in the sound source LSI 170 (step S104). For example, the CPU 110 may calculate an offset amount of a parameter related to each level, each rate, and so on of the noise sound envelope on the basis of the velocity acquired in step S103, and may set the calculated offset amounts in the sound source LSI 170.

Next, the CPU 110 executes noise sound production processing, which is processing for instructing the sound source LSI 170 to produce a noise sound corresponding to the selected instrument sound in accordance with the set noise sound envelope (step S105). Then, the CPU 110 ends the middle switch on processing.

(Rear Switch on Processing)

FIG. 10 is a flowchart illustrating the procedure of rear switch on processing. The algorithm illustrated in the flowchart of FIG. 10 is stored as a program in the ROM 130 or the like, and is executed by the CPU 110.

As illustrated in FIG. 10, when the CPU 110 detects turning on of the rear switch 164, the CPU 110 determines whether a noise sound corresponding to the key number of the key 161 provided with the rear switch 164 that was switched on is being produced by the noise sound production processing (step S201).

In the case where it is determined that a noise sound is not being produced (step S201: NO), the CPU 110 advances to the processing of step S202. Then, the CPU 110 executes musical sound production processing, which is processing for instructing the sound source LSI 170 to produce the main musical sound corresponding to the selected musical instrument in accordance with the set musical sound envelope (step S202). Then, the CPU 110 ends the rear switch on processing.

In the case where it is determined that the noise sound is being produced (step S201: YES), the CPU 110 confirms the setting of Key On Mode (step S203). For example, Key On Mode can be set by being selected in advance in accordance with the musical instrument sound selected on the switch panel 140 as described above.

In the case where a setting of Key On Mode=0 is confirmed (step S203: 0), the CPU 110 determines whether the level L2 is set to 0 in the noise sound envelope for when a key is pressed (step S204). In the case where it is determined that level L2 is set to 0, that is, the noise sound is a decaying sound (step S204: YES), the CPU 110 advances to the processing of step S205. As illustrated in FIG. 6A, the CPU 110 puts production of the main musical sound corresponding to the key number into a pending state (step S205) and ends the rear switch on processing. Although not illustrated, after ending the rear switch on processing, the CPU 110 continues to monitor the level of the noise sound that decreases at the rate R2 and when the level of the noise sound reaches L2 (i.e., 0), the CPU 110 executes musical sound production processing.

In the case where a setting of Key On Mode=1 is confirmed (step S203: 1) or when it is determined that the level L2 is not set to 0 in the case where a setting of Key On Mode=0 was confirmed (step S204: NO), the CPU 110 advances to the processing of step S206. Here, the case where level L2 is not set to 0, for example, corresponds to the case where the noise sound is a sustained sound. In other words, even in the case where the CPU 110 confirms the setting of Key On Mode=0, in the case where the noise sound is a sustained sound, the CPU 110 advances to the same processing as in the case where the CPU 110 exceptionally confirms the setting of Key On Mode=1 in order to avoid a situation where the musical sound production processing is not executed indefinitely. Then, as illustrated in FIG. 6B, the CPU 110 executes noise sound continuation processing (continuation processing) (step S206), which is processing for continuing production of the noise sound produced by the noise sound production processing without changing the parameters of the set noise sound envelope. In addition, the CPU 110 then executes the musical sound production processing (step S202) and ends the rear switch on processing.

In the case where a setting of Key On Mode=2 is confirmed (step S203: 2), the CPU 110 advances to step S207. Then, the CPU 110 executes noise sound weakening processing (step S207), which is processing for weakening, including silencing, the noise sound produced by the noise sound production processing by changing the parameters of the set noise sound envelope. More specifically, the CPU 110 executes the noise sound weakening processing by controlling the sound source LSI 170 so as to set the rate R3 as illustrated in FIG. 6C. In addition, the CPU 110 then executes the musical sound production processing (step S202) and ends the rear switch on processing.

(Front Switch Off Processing)

FIG. 11 is a flowchart illustrating the procedure of front switch off processing. The algorithm illustrated in the flowchart of FIG. 11 is stored as a program in the ROM 130 or the like, and is executed by the CPU 110. When the CPU 110 detects turning off of the front switch 162 after detecting turning on of the middle switch 163 and/or the rear switch 164, the CPU 110 executes front switch off processing.

As illustrated in FIG. 11, when the CPU 110 detects turning off of the front switch 162 caused by releasing of the key, the CPU 110 determines whether the main musical sound corresponding to the key number of the key 161 provided with the front switch 162 that was turned off is being produced by the musical sound production processing (step S301).

In the case where it is determined that the main musical sound is not being produced (step S301: NO), the CPU 110 advances to the processing of step S302. This case, for example, corresponds to the case in which turning off of the front switch 162 is detected after detection of turning on of the middle switch 163 and without detection of turning on of the rear switch 164. The CPU 110 determines whether the noise sound corresponding to the key number is being produced by the noise sound production processing (step S302).

In the case where it is determined that the noise sound is not being produced (step S302: NO), the CPU 110 ends the front switch off processing.

In the case where it is determined that the noise sound is being produced (step S302: YES), the CPU 110 confirms the setting of Key Off Mode (step S303). For example, Key Off Mode can be set by being selected in advance in accordance with the musical instrument sound selected on the switch panel 140 as described above.

In the case where a setting of Key Off Mode=0 is confirmed (step S303: 0), the CPU 110 determines whether the level L2 is set to 0 in the noise sound envelope for when a key is released (step S304). In the case where it is determined that the level L2 is set to 0, that is, the noise sound is a decaying sound (step S304: YES), as illustrated in FIG. 8A, the CPU 110 causes production of the noise sound produced by the noise sound production processing to continue and ends the front switch off processing.

In the case where a setting of Key Off Mode=1 is confirmed (step S303: 1) or when it is determined that the level L2 is not set to 0 in the case where a setting of Key Off Mode=0 was confirmed (step S304: NO), the CPU 110 advances to the processing of step S305. Then, the CPU 110 executes noise sound weakening processing (step S305), which is processing for weakening, including silencing, the noise sound produced by the noise sound production processing by changing the parameters of the set noise sound envelope. More specifically, the CPU 110 executes the noise sound weakening processing by controlling the sound source LSI 170 so as to set the rate R4 as illustrated in FIG. 8B. After that, the CPU 110 ends the front switch off processing.

On the other hand, in the case where it is determined that the main musical sound is being produced (step S301: YES), the CPU 110 advances to the processing of step S306. This case, for example, corresponds to the case in which turning on of the rear switch 164 is also detected after turning on of the middle switch 163 is detected, and then turning off of the front switch 162 is detected. Then, the CPU 110 starts executing musical sound weakening processing (step S306), which is processing for weakening, including silencing the main musical sound produced by the musical sound production processing by changing the parameters of the set musical sound envelope. For example, the CPU 110 may execute the musical sound weakening processing by controlling the sound source LSI 170 so as to set rate R4 as illustrated in FIG. 8B similarly to as in the processing of step S305.

Next, the CPU 110 determines whether the noise sound corresponding to the key number is being produced by the noise sound production processing (step S307).

In the case where it is determined that the noise sound is not being produced (step S307: NO), the CPU 110 ends the front switch off processing.

In the case where it is determined that a noise sound is being produced (step S307: YES), the CPU 110 advances to the processing of step S308. Then, the CPU 110 executes noise sound weakening processing (step S308) by changing the parameters of the set noise sound envelope. For example, the CPU 110 may execute the noise sound weakening processing by controlling the sound source LSI 170 so as to set rate R4 as illustrated in FIG. 8B similarly to as in the processing of step S305. After that, the CPU 110 ends the front switch off processing.

As described above, upon detecting turning on of the middle switch 163 (first switch), the electronic keyboard instrument 100 according to this embodiment executes noise sound production processing for instructing production of a noise sound corresponding to a selected musical instrument sound in accordance with the set noise sound envelope. In addition, upon detecting turning on of the rear switch 164 (second switch), the electronic keyboard instrument 100 executes musical sound production processing for instructing production of a main musical sound corresponding to the selected musical instrument sound. Since the electronic keyboard instrument 100 independently controls the noise sound and the main musical sound and produces the noise sound by setting an appropriate envelope for the waveform of the noise sound, a noise sound generated in an acoustic musical instrument can be suitably reproduced.

More specifically, the player of an actual acoustic instrument begins to perform a performance preparatory action that may cause a noise sound to be generated early and then continues to perform the preparatory action, and in this way makes adjustments so as to produce the main musical sound at the timing of notes on a score for example. For example, the player of a wind instrument produces the main musical sound by beginning a performance preparatory action of breathing into the wind instrument early and then continuing the action of breathing into the wind instrument until the pipe vibrates with a certain level of pressure. In addition, the player of a plucked string instrument such as a guitar produces the main musical sound by beginning a performance preparatory action of moving a pick toward and pressing the pick against a string in advance and then continuing the action of moving the pick until the string separates from the pick and a string vibration is initiated.

However, the electronic keyboard instrument of the related art is unable to independently control the noise sound and the main musical sound, and therefore a noise sound included at the beginning of the main musical sound is produced in response to a key press operation and then the player has to wait for the transition to production of the main musical sound itself. Therefore, the player has to produce the main musical sound at the timing of notes on a score by just performing key press operations with expected transition times early without performing the series of performance preparatory actions described above. Furthermore, the electronic keyboard instrument of the related art also has a problem in that, in the waveform memory read out method, the duration of the noise sound included at the beginning of the main musical sound varies depending on the speed at which the waveform data is read out and so forth, and therefore this makes it more difficult for players to perform key press operations early as described above. Therefore, in the electronic keyboard instrument of the related art, the duration of the noise sound has to be set to a short time in order to make it easier for the player to perform key press operations. Consequently, there is a problem in that a noise sound generated in an acoustic musical instrument cannot be suitably reproduced.

The electronic keyboard instrument 100 according to this embodiment is capable of independently controlling the noise sound and the main musical sound, and can therefore solve the above-described problem. In other words, the electronic keyboard instrument 100 allows the player to control the timings at which the noise sound and the main musical sound are produced in accordance with the key press speed (or amount of depression) and the player is able to easily produce the main musical sound at the timing of the notes. Furthermore, variations in the duration of the noise sound depending on the speed at which the waveform data is read out and so forth are also suppressed and there is no need to set the duration of the noise sound to a short time. Therefore, the electronic keyboard instrument 100 can suitably reproduce noise sounds generated in acoustic musical instruments.

Furthermore, the electronic keyboard instrument 100 can execute processing for weakening, including silencing, the noise sound by changing the parameters of the set noise sound envelope upon detecting turning on of the rear switch 164. As a result, the electronic keyboard instrument 100 can reproduce a situation in which the noise sound does not continue to be produced after production of the main musical sound has started.

In addition, the electronic keyboard instrument 100 can be configured such that even when the electronic keyboard instrument 100 detects turning on of the rear switch 164, the electronic keyboard instrument 100 may execute noise sound continuation processing without changing the parameters of the set noise sound envelope. As a result, the electronic keyboard instrument 100 can reproduce a situation in which the noise sound does continue to be produced after production of the main musical sound has started.

Furthermore, in the case where the tone color of a plucked string instrument is selected, the electronic keyboard instrument 100 may execute processing for weakening, including silencing, the noise sound by changing the parameters of the set noise sound envelope upon detecting turning on of the rear switch 164. On the other hand, in the case where the tone color of a wind instrument is selected, the electronic keyboard instrument 100 may execute noise sound continuation processing without changing the parameters of the set noise sound envelope upon detecting turning on of the rear switch 164. Thus, the electronic keyboard instrument 100 can switch the processing to be performed with respect to the noise sound in accordance with the selected musical instrument. Therefore, the electronic keyboard instrument 100 is able to reproduce a state in which the breath noise sound of a wind instrument continues to be produced after the main musical sound begins to be produced as well as a state in which the picking noise sound of a plucked string instrument does not continue to be produced after the main musical sound begins to be produced, for example.

Furthermore, upon determining that the noise sound is being produced when turning off of the front switch 162 is detected, the electronic keyboard instrument 100 may execute processing for weakening, including silencing, the noise sound by changing the parameters of the set noise sound envelope in the front switch off processing. As a result, the electronic keyboard instrument 100 can reproduce a state in which the noise sound weakens after the player stops playing.

In addition, upon determining that the main musical sound is being produced when turning off of the front switch 162 is detected, the electronic keyboard instrument 100 may execute processing for weakening, including silencing, the main musical sound in the front switch off processing. As a result, the electronic keyboard instrument 100 can reproduce a state in which the main musical sound weakens together with the noise sound after the player stops playing.

The present invention is not limited to the above-described embodiment and can be changed and improved in various ways within the scope of the claims.

For example, a case in which the plurality of keys 161 of the electronic keyboard instrument 100 are each provided with three switches was described as an example in the above-described embodiment, but the plurality of keys 161 may instead be each provided with only two switches. In other words, the plurality of keys 161 may each be provided with only a front switch and a rear switch that are sequentially turned on when the key is pressed. Then, for example, the electronic keyboard instrument 100 may execute the processing illustrated in FIG. 9 upon detecting turning on of the front switch, may execute the processing illustrated in FIG. 10 upon detecting turning on of the rear switch, and may execute the processing illustrated in FIG. 11 upon detecting turning off of the front switch. In the case where the plurality of keys 161 are each provided with only two switches, the electronic keyboard instrument 100 may omit the processing related to velocity when executing the processing illustrated in FIG. 9.

In addition, the present invention is not limited to the above-described embodiment, and may be modified in various ways in the implementation phase within a range that does not deviate from the gist of the present invention. Furthermore, the functions executed in the above-described embodiment may be appropriately combined with each other as much as possible. A variety of stages are included in the above-described embodiment, and a variety of inventions can be extracted by using appropriate combinations constituted by a plurality of the disclosed constituent elements. For example, even if some constituent elements are removed from among all the constituent elements disclosed in the embodiment, the configuration obtained by removing these constituent elements can be extracted as an invention provided that an effect is obtained.

It will be apparent to those skilled in the art that various modifications and variations can be made in the present invention without departing from the spirit or scope of the invention. Thus, it is intended that the present invention cover modifications and variations that come within the scope of the appended claims and their equivalents. In particular, it is explicitly contemplated that any part or whole of any two or more of the embodiments and their modifications described above can be combined and regarded within the scope of the present invention.

What is claimed is:

1. An electronic keyboard instrument comprising:

a keyboard including a plurality of keys;

a plurality of switches for each of the plurality of keys, the plurality of switches in each of the plurality of keys including a first switch and a second switch that are sequentially turned on in the order of the first switch first and the second switch thereafter when the key is pressed; and a processor;

wherein the processor:

causes a noise sound corresponding to a musical instrument sound to be produced in accordance with a prescribed first envelope that determines volume changes over time, upon detecting turning on of the first switch by pressing of the key; and causes a main musical sound corresponding to said musical instrument sound to be produced after detecting turning on of the second switch.

2. The electronic keyboard instrument according to claim 1, wherein the processor causes the noise sound being produced to be muted by changing a parameter of the prescribed first envelope in response to detecting turning on of the second switch.

3. The electronic keyboard instrument according to claim 1, wherein the processor causes the noise sound being produced to continue being produced in accordance with the prescribed first envelope without changing any parameter of the prescribed first envelope even when turning on of the second switch is detected.

4. The electronic keyboard instrument according to claim 1, further comprising:

an operation element to receive a selection of a musical instrument sound from among a plurality of preset musical instrument sounds as said musical instrument sound, wherein the processor:

causes the noise sound being produced to be muted by changing a parameter of the prescribed first envelope upon detecting turning on of the second switch when the musical instrument sound selected by an operation of the operation element is a sound of a plucked string instrument; and causes the noise sound being produced to continue being produced in accordance with the prescribed first envelope without changing any parameter of the prescribed first envelope even when turning on of the second switch is detected when the musical instrument sound selected by an operation of the operation element is a sound of a wind instrument.

5. The electronic keyboard instrument according to claim 1, wherein in each of the plurality of keys, the plurality of switches further includes a third switch such that the third, the first, and the second switches are sequentially turned on in the order of the third switch, the first switch, and the second switch when the key is pressed, and are sequentially turned off in the order of the second switch, the first switch, and the third switch when the key is released, and wherein the processor:

when detecting turning off the third switch by releasing the key, determines whether the noise sound is being produced; and causes the noise sound being produced to be muted by changing a parameter of the prescribed first envelope when the processor determines that the noise sound is being produced.

6. The electronic keyboard instrument according to claim 5, wherein the processor:

when detecting turning off the third switch by releasing of the key, determines whether the main musical sound is being produced, and causes the main musical sound being produced to be muted when the processor determines that the main musical sound is being produced.

7. A method performed by a processor in an electronic keyboard instrument that includes, in addition to the processor: a keyboard including a plurality of keys; and a plurality of switches provided for each of the plurality of keys, the plurality of switches in each of the plurality of keys including a first switch and a second switch that are sequentially turned on in the order of the first switch first and the second switch thereafter when the key is pressed, the method comprising, via the processor:

causing a noise sound corresponding to a musical instrument sound to be produced in accordance with a prescribed first envelope that determines volume changes over time, upon detecting turning on of the first switch by pressing of the key; and causing a main musical sound corresponding to said musical instrument sound to be produced after detecting turning on of the second switch.

8. The method according to claim 7, further comprising, via the processor:

causing the noise sound being produced to be muted by changing a parameter of the prescribed first envelope in response to detecting turning on of the second switch.

9. The method according to claim 7, further comprising, via the processor:

causing the noise sound being produced to continue being produced in accordance with the prescribed first envelope without changing any parameter of the prescribed first envelope even when turning on of the second switch is detected.

10. The method according to claim 7, wherein the electronic keyboard instrument further includes an operation element to receive a selection of a musical instrument sound from among a plurality of preset musical instrument sounds as said musical instrument sound, and wherein the method includes, via the processor:

causing the noise sound being produced to be muted by changing a parameter of the prescribed first envelope upon detecting turning on of the second switch when the musical instrument sound selected by an operation of the operation element is a sound of a plucked string instrument, and causing the noise sound being produced to continue being produced in accordance with the prescribed first envelope without changing any parameter of the prescribed first envelope even when turning on of the second switch is detected when the musical instrument sound selected by an operation of the operation element is a sound of a wind instrument.

11. The method according to claim 7, wherein in each of the plurality of keys, the plurality of switches further includes a third switch such that the third, the first, and the second switches are sequentially turned on in the order of the third switch, the first switch, and the second switch when the key is pressed, and are sequentially turned off in the order of the second switch, the first switch, and the third switch when the key is released, and wherein the method includes, the via processor:

when detecting turning off the third switch by releasing the key, determining whether the noise sound is being produced, and causing the noise sound being produced to be muted by changing a parameter of the prescribed first envelope when determining that the noise sound is being produced.

12. The method according to claim 11, further comprising, via the processor;

when detecting turning off the third switch by releasing of the key, determining whether the main musical sound is being produced, and causing the main musical sound being produced to be muted when determining that the main musical sound is being produced.

13. A non-transitory computer-readable storage medium having stored thereon an program executable by a processor in an electronic keyboard instrument that includes, in addition to the processor: a keyboard including a plurality of keys; and a plurality of switches provided for each of the plurality of keys, the plurality of switches in each of the plurality of keys including a first switch and a second switch that are sequentially turned on in the order of the first switch first and the second switch thereafter when the key is pressed, the program causing the processor to perform the following:

causing a noise sound corresponding to a musical instrument sound to be produced in accordance with a prescribed first envelope that determines volume changes over time, upon detecting turning on of the first switch by pressing of the key; and causing a main musical sound corresponding to said musical instrument sound to be produced after detecting turning on of the second switch.

* * * * *